United States Patent [19]

Nakamura et al.

[11] Patent Number: 4,572,860

[45] Date of Patent: Feb. 25, 1986

[54] THERMAL TRANSFER RECORDING MEDIUM

[75] Inventors: Masaki Nakamura; Takao Abe; Kunihiro Koshizuka; Shigehiro Kitamura; Fumio Ishii; Yuji Hotta, all of Hino, Japan

[73] Assignee: Konishiroku Photo Industry Co., Ltd., Tokyo, Japan

[21] Appl. No.: 657,574

[22] Filed: Oct. 3, 1984

[30] Foreign Application Priority Data

Oct. 12, 1983 [JP] Japan ..... 58-189295
Dec. 26, 1983 [JP] Japan ..... 58-244266

[51] Int. Cl.[4] ..... B41M 5/26

[52] U.S. Cl. ..... 428/216; 8/471; 428/207; 428/212; 428/412; 428/423.1; 428/423.7; 428/473.5; 428/483; 428/484; 428/488.4; 428/522; 428/913; 428/914

[58] Field of Search ..... 8/470, 471; 346/200, 346/226; 428/204, 207, 212, 215, 216, 336, 412, 423.1, 423.7, 473.5, 480, 483, 484, 488.1, 488.4, 522, 913, 914

[56] References Cited

FOREIGN PATENT DOCUMENTS 0030892 3/1981 Japan ..... 428/914

*Primary Examiner*—Bruce H. Hess
*Attorney, Agent, or Firm*—Frishauf, Holtz, Goodman & Woodward

[57] ABSTRACT

There is disclosed a thermal transfer recording medium which comprises a support, a coloring agent layer containing a heat fusible substance formed on one surface of said support and a backing layer on the other surface of said support, wherein said backing layer contains a resin selected from urethane resins or vinyl chloride resins and a higher fatty acid which is solid or meta-solid at room temperature.

The thermal transfer recording medium of this invention can suppress effectively generation of the sticking phenomenon, and has no deleterious effect on the thermal head without either contamination or abrasion of the thermal head.

20 Claims, No Drawings

THERMAL TRANSFER RECORDING MEDIUM

BACKGROUND OF THE INVENTION

This invention relates to a thermal transfer recording medium, particularly to a thermal transfer recording medium which is free from occurrence of blocking during storage, without contamination or abrasion of the thermal head during usage and also capable of preventing generation of sticking phenomenon.

As one of techniques concerning thermal recording medium, heat-sensitive paper has been widely known for its ease in handling. For example, Japanese Provisional Patent Publication No. 2795/1982 discloses a technique employing silicon-modified wax together with a binder as the protective layer. However, such a heat-sensitive paper as the recording medium cannot make the printed (recorded) images indelible, but they will readily be color formed by heat or an organic solvent to result in the disadvantage that storability of the printed (recorded) image was poor. In contrast, there is also known a thermal transfer recording medium of the type employing a heat fusible substance as the recording medium excellent in alteration resistance and storability.

Whereas, in the case of such a melt-transfer type thermal transfer recording medium employing a polymeric film such as a polyethyleneterephthalate film as the support, a part of the film support may be melted by a thermal head and stuck through fusion onto the thermal head. This phenomenon is called the sticking phenomenon, which will lower markedly the recording quality and ultimately the film support will be baked onto the thermal head to make delivery of the thermal transfer recording medium no longer possible.

For prevention of this sticking phenomenon, a paper excellent in heat resistance such as condenser paper may be used as the support. However, when such a paper is used, due to poor thermal conductivity from the thermal head, the power applied on the thermal head must be increased, whereby the life of the thermal head will be markedly damaged to a great disadvantage.

On the other hand, there is the technique of employing a backing layer for prevention of the sticking phenomenon. For example, Japanese Provisional Patent Publication No. 7467/1980 proposes to provide a heat-resistant protective film such as of a silicone resin on a film support, but this technique involves the drawback that the heating head is abraded after recording for a long time due to the great friction with the heating head. Also, Japanese Provisional Patent Publication No. 129789/1982 proposes to provide a resin layer containing a surfactant or an organic salt which is solid or meta-solid at room temperature on a film support. This technique involves the drawback that the resin layer absorbs moisture under humid conditions such as during the rainy season, whereby the layer becomes sticky to cause contamination of the heating head. Further, Japanese Provisional Patent Publication No. 187396/1983 discloses a technique for enhancing heat resistance of the backing layer. More specifically, according to this technique, 5 to 40 parts by weight of a compound having diisocyanate or triisocyanate or amino group are added per 100 parts by weight of a thermoplastic resin having —OH group or —COOH group, thereby curing the backing layer through crosslinking. Indeed, this technique is capable of affording sticking resistance, but because of aiming at improvement of heat resistance with the reaction product, difficulties are encountered in manufacturing process and it is not possible to prepare a backing layer with uniform film thickness.

Accordingly, Japanese Provisional Patent Publication No. 171992/1983 proposes to use waxes together with thermoplastic resins, in order to enhance the lubricity of the backing layer. However, when the paraffinic or ethylenic waxes disclosed herein are employed, not only the defect of contamination of head, but also there is the defect of occurrence of blocking during storage of the thermal transfer recording medium. Further, Japanese Provisional Patent Publication No. 155794/1981 proposes to provide a resin layer containing an inorganic pigment having high lubricity on a film support, but this technique involved the drawback that the inorganic pigment peeled off from the resin film and contaminated the thermal head.

SUMMARY OF THE INVENTION

This invention has been accomplished in view of the above points, and an object of this invention is to provide a thermal transfer recording medium, which can not only suppress effectively generation of the sticking phenomenon, but also has no deleterious effect on the thermal head without either contamination or abrasion of the thermal head.

Another object of this invention is to provide a thermal transfer recording medium which is free from the blocking phenomenon during storage.

Still another object of this invention is to provide a thermal transfer recording medium, of which the backing layer is free from stiffening or blocking phenomenon when the thermal transfer recording medium is rolled up in the manufacture thereof.

Other objects of the present invention will be apparent from the description given below.

The present inventors have found, as a result of extensive studies, that the above objects can be accomplished in a thermal transfer recording medium having a coloring agent layer containing a heat fusible substance on one surface of a film support and a backing layer on the other surface, by incorporating in said backing layer a resin selected from urethane resins or vinyl chloride resins, particularly those soluble in a solvent, and a higher fatty acid which is solid or meta-solid at room temperature, to accomplish this invention.

In other words, the present inventor has found that it is more effective for prevention of the sticking phenomenon and abrasion of a thermal head to improve lubricity of the recording medium than to employ a means for improving heat resistance by coating of the backing layer or imparting matte property, and also that use of such specific substances can effect prevention of contamination of the thermal head as well as prevention of blocking during storage, to accomplish this invention.

DESCRIPTION OF THE PREFERRED EMBODIMENTS

This invention is to be described in further detail below.

The basic constitution of the thermal transfer recording medium of this invention has a color layer material containing at least a heat fusible substance on the upper surface of a film support and at least a backing layer on the lower surface.

The backing layer in the present invention contains at least one kind of resin selected from urethane resins or vinyl chloride resins and a higher fatty acid which is solid or meta-solid at room temperature.

The urethane resin or vinyl chloride resin of this invention may include urethane resins or vinyl chloride resins known in the art, which are not particularly limited but more preferably soluble in a solvent.

The urethane resin to be used in this invention contains a urethane copolymer, and should preferably have a softening point of 50° C. to 250° C. (measured value according to the ring and ball method). These are commercially available under the trade names of, for example, Paraprene 22S produced by Nippon Polyurethane Co. (softening point: 105° C.), Paraprene 26S produced by the same company (softening point: 156° C.), Pandex T-5102S produced by Dainippon Ink Co. (softening point: 80° to 100 ° C.), Pandex T-5000 produced by the same company (softening point: 80° to 100° C.), etc.

The vinyl chloride resin to be used in the present invention contains a vinyl chloride copolymer such as vinyl chloride-vinyl acetate copolymer, and should preferably have a softening point of 50° C. to 250° C. (measured value according to the ring and ball method). These are commercially available under the trade names of, for example, VYHH produced by Union Carbide Co. (softening point: 150° C. to 190° C.), VAGH produced by the same company (softening point: 150° C. to 190° C.), etc.

The higher fatty acid to be used in the present invention is a fatty acid having 8 or more carbon atoms (preferably 12 or more) as exemplified by caprylic acid, capric acid, sebacic acid, lauric acid, myristic acid, palmitic acid, stearic acid, oleic acid, behenic acid, erucic acid, lignoceric acid, melissic acid and the like. With a fatty acid having carbon atoms less than 8, sticking will be generated so that the no object of this invention is not accomplished. Thus, one specific feature of this invention is to employ a higher fatty acid which is solid or meta-solid at room temperature, whereby the objects of this invention can be accomplished for the first time. Inorganic pigments are not desired to be used in the backing layer, because they will contaminate the thermal head after prolonged recording.

The composition ratio in the backing layer of this invention is not limitative, but it is preferred to employ 50 to 98 parts (by weight, hereinafter the same), more preferably 70 to 95 parts, of a resin selected from urethane resins or vinyl chloride resins, and 2 to 50 parts, more preferably 5 to 30 parts of a higher fatty acid which is solid or meta-solid at room temperature, per 100 parts of the total amount of the backing layer. If the resin selected from urethane resins or vinyl chloride resins exceeds 98 parts, blocking will occur during storage, while an amount of a higher fatty acid which is solid or meta-solid at room temperature in excess of 50 parts will result in contamination of thermal head during usage. The backing layer may have a thickness preferably of 0.03 to 2.0 μm, more preferably of 0.1 to 0.5 μm. The backing layer of the present invention may also contain other components than the higher fatty acid which is solid or meta-solid at room temperature and the resin selected from urethane resins or vinyl chloride resins, such as heat fusible substances or other resins.

Such resin components may preferably be those having good adhesion to the film support, for example, polyvinyl acetate, polyvinyl butyral, polyvinylidene chloride, vinyl acetate-ethylene copolymer, cellulose derivatives such as ethylcellulose, cellulose acetate, cellulose acetate butyrate and nitrocellulose, epoxy resin, phenol resin, melamine resin, urea resin, silicone resin, fluorine resin, polycarbonate, polyethylene, polyester resin, polyether, polypropylene, polyamide, styrenemaleic acid resin, polyvinyl alcohol, etc.

The backing layer may also contain a heat fusible substance which preferably has a softening point (as measured by the ring and ball method) or a melting point (as measured by Yanagimoto MJP-2 Model) of 50° to 120° C. Examples of such heat fusible substance are paraffinic waxes such as paraffin wax, microwax, etc.; natural waxes such as beeswax, carnauba wax, wood wax, etc.; ester waxes such as Hoechst wax, etc.; higher alcohols such as stearyl alcohol, palmityl alcohol, etc.; higher amides such as stearoamide, oleoamide, palmitinoamide, etc.; esters such as butyl stearate, ethyl palmitate, myristyl stearate, etc.

The film support to be used in the present invention may be a resin film which is excellent in surface smoothness and dimensional stability. Typical examples may include resin films such as a polyethyleneterephthalate film, a polyimide film, a polycarbonate film, etc. (inclusive of polymers, copolymers and terpolymers). These films may have a thickness which is not limited, but preferably about 2 to 15 μm. These supports may be subjected, in order to enhance adhesion of the backing layer, to surface treatment such as corona discharging, glow discharging or other electron impingement, flame treatment, UV-ray irradiation, oxidation treatment, saponification treatment, surface roughening treatment, or subbing treatment, etc.

The backing layer of this invention may be provided by coating on the film support according to any desired method, for example, by hot melt coating or solvent coating of a coating liquid containing a backing layer composition dispersed in a suitable solvent. As the solvent to be used in this method, any solvent may be available, so long as it can dissolve or disperse the respective components therein to give a coating liquid. For example, there may be employed one or a combination or two or more compounds such as methyl ethyl ketone, tetrahydrofuran, N,N'-dimethylformamide, dimethyl sulfoxide, etc.

In carrying out coating, it is possible to employ any desired coating method or coating technique such as the reverse roll coater method, the extrusion coater method, the gravure coater method or the wire bar coating method.

In the following, the coloring agent layer of this invention is to be explained.

The colorant to be contained in the coloring agent layer of this invention may be selected suitably from the dyes known in the art, and it can be selected from among direct dyes, acidic dyes, basic dyes, disperse dyes, oilsoluble dyes, etc. The dye to be used in the coloring agent layer of this invention may be a dye which can be transferred (migrated) together with the heat fusible substance, and it can also be a pigment other than the above dyes. More specifically, the colorants as mentioned below may be used. That is, yellow dyes may preferably be Kayalon Polyester Light Yellow 5G-S (Nippon Kayaku), Aizen Spilon GRH Special (Hodogaya), Sumiplast Yellow FG (Sumitomo), Aizen Spilon Yellow GRH (Hodogaya), and the like. Red dyes may preferably be Diacelliton Fast Red R (Mitsubishi Kasei), Dianix Brilliant Red BS-E (Mitsubishi Kasei), Sumiplast Red FB (Sumitomo), Sumiplast Red HFG (Sumitomo), Kayalon Polyester Pink RCL-E (Nippon Kayaku), Aizen Spilon Red GEH Special (Hodogaya) and the like. Blue dyes may preferably be Diacelliton Fast Brilliant Blue R (Mitsubishi Kasei), Dianix Blue EB-E (Mitsubishi Kasei), Kayalon Polyester Blue B-SF Conc. (Nippon Kayaku), Sumiplast Blue 3R (Sumitomo), Sumiplast Blue G (Sumitomo) and the like. Yellow pigments may be, for example, Hansa Yellow 3G, Tartrazine Lake, etc.; red pigments, for example, Brilliant Carmine FB-Pure (Sanyo Shikiso), Brilliant Carmine 6B (Sanyo Shikiso), Alizarine Lake, etc.; blue pigments, for example, Celrean Blue, Sumika Print Cyanine Blue GN-O (Sumitomo), Phthalocyanine Blue, etc.; and black pigments, for example, carbon black, oil black and the like.

In the coloring agent layer of this invention, a heat fusible substance is employed. The heat fusible substance should preferably be a solid or a meta-solid substance having a melting point of 40° to 120 ° C. (as measured by Yanagimoto MPJ-2 Model). Specific examples may include vegetable waxes such as carnauba wax, wood wax, auricuri wax, espal wax, etc.; animal waxes such as beeswax, insect wax, shellac wax, whale wax, etc.; petroleum waxes such as paraffin wax, microcrystalline wax, ester wax, acid wax, etc.; mineral waxes such as montane wax, ozocerite, ceresin, etc.; and other than these waxes, higher fatty acids such as palmitic acid, stearic acid, margaric acid, behenic acid, etc.; higher alcohols such as palmityl alcohol, stearyl alcohol, behenyl alcohol, marganyl alcohol, myrisyl alcohol, eicosanol, etc.; higher fatty acid esters such as cetyl palmitate, myrisyl palmitate, cetyl stearate, myrisyl stearate, etc.; amides such as acetamide, propionic acid amide, palmitic acid amide, stearic acid amide, amide wax, etc.; rosin derivatives such as ester gum, rosin maleic acid resin, rosin phenol resin, hydrogenated rosin, etc.; polymeric compounds having a softening point of 50° to 120° C. such as phenol resin, terpene resin, cyclopentadiene resin, aromatic resin, etc.; higher amines such as stearylamine, behenylamine, palmitylamine, etc.; polyethyelene oxides such as polyethylene glycol 4000, polyethylene glycol 6000, etc. These can be used either singly or in combination.

The composition ratio in the coloring agent layer of this invention is not limitative, but it is preferable to employ 50 to 90 parts of a heat fusible substance, 5 to 20 parts of a colorant and 0 to 30 parts of a resin (more preferably 5 to 30 parts), per 100 parts of the total amount of the coloring agent layer.

In the coloring agent layer of this invention, in addition to the above components, various additives may also be incorporated. For example, as the softening agent, a vegetable oil such as castor oil, linseed oil, olive oil, etc., an animal oil such as whale oil, and a mineral oil may preferably be used.

The coloring agent layer may have a thickness of 15 μm or less, preferably 2 to 8 μm.

According to the present invention, in a thermal transfer recording medium having a coloring agent layer containing a heat fusible substance on one surface of a film support and a backing layer on the other surface, the aforesaid backing layer contains a resin selected from urethane resins or vinyl chloride resins and a higher fatty acid which is solid or meta-solid at room temperature, and therefore the above-mentioned objects of this invention can be accomplished. In particular, there is also the effect of realizing so-called maintenance-free performance.

This invention is further described by referring to the following Examples, but the embodiments of the present invention are not limited thereto.

EXAMPLE 1

A coating solution for backing layer having the composition shown below was applied by a wire bar on the lower surface of a polyethyleneterephthalate film support with a thickness of 6 μm to provide by coating a backing layer with a thickness after drying of 0.5 μm.

[Coating Solution for Backing Layer]

Polyurethane resin (Paraprene P-22S, produced by Nippon Polyurethane Co., softening point: 105° C.)—255 parts by weight
Stearic acid—45 parts by weight
Tetrahydrofuran—30 parts by weight.

Next, the above polyethyleneterephthalate film was coated on its upper surface by a wire bar with a thermal transferable coloring agent layer composition, and dried to obtain a thermal transfer recording medium sample (1) having a coloring agent layer with a thickness of 3.4 μ.

[Coloring Agent Layer Composition]

Carnauba wax—40 parts by weight
Wax (Nisseki Microwax 155)—40 parts by weight
Olive oil—5 parts by weight
Carbon Black—15 parts by weight.

EXAMPLE 2

According to entirely the same procedure as in Example 1 except for using a vinyl chloride-vinyl acetate copolymer (VYHH, produced by Union Carbide Co., softening point 150° C.–190° C.) in place of the polyurethane resin in Example 1 to obtain a thermal transfer recording medium sample (2) of this invention with a dried film thickness of the backing layer of 0.5 μm and a dried film thickness of the coloring agent layer of 3.4 μm.

Comparative Example 1

A comparative sample (3) was prepared on the basis of Example 1 as disclosed in Japanese Provisional Patent Publication No. 171992/1983. That is, a coating solution having the composition as shown below was applied on the lower surface of the same support as employed in Example 1 according to the same method as in Example 1 to provide a backing layer with a dried film thickness of 0.5 μm. Also, according to the same method as in Example 1, on the upper surface of the support, a coloring agent layer with a dried film thickness of 3.4 μm was provided by coating to obtain a thermal transfer recording medium sample (3) for comparative purpose.

[Coating Solution for Backing Layer]

Cellulose acetate propionate—10 parts by weight
Lecithin—4 parts by weight
Toluene/Methyl ethyl ketone/2propanol (1:1:1)—66 parts by weight.

Comparative Example 2

According to entirely the same procedure as in Example 1 except for using ethyl cellulose in place of the polyurethane resin and also 2-propanol in place of methyl ethyl ketone in Example 1, a thermal transfer recording medium sample (4) for comparative purpose having a backing layer with a dried film thickness of 0.5 μm and a coloring agent layer with a dried film thickness of 3.4 μm was obtained.

These thermal transfer recording samples were employed for printing letters by means of a thermal printer (a machine having a thin film type line thermal head with a heat-generating element density of 8 dot/mm) on plain paper.

Presence of generation of sticking phenomenon was examined by carrying out recording under the conditions of an application power per one heating element of 0.7 W and an application time of 2.3 milliseconds and observing whether the thermal transfer recording medium can be driven smoothly or not. Contamination of heating heads was examined after printing letters with solid images on 20 sheets and 100 sheets of plain papers of A4 size (Beck smoothness of 200 sec.) and observing contamination of the thermal heads with a loupe.

Blocking phenomenon was examined by superposing two sheets of samples with the backing layer of one sheet faced to the coloring agent layer of the other, leaving these sheets to stand at a temperature of 50° C. under application of a pressure of 100 g/cm$^2$ for 24 hours, peeling off the sample sheets and observing the presence of the coloring agent layer composition which had migrated to the backing layer.

These results are shown in Table 1.

TABLE 1

| Sample No. | Presence of sticking | Contamination of thermal head (*1) A4 size 20 sheets | A4 size 100 sheets | Presence of generation of blocking |
|---|---|---|---|---|
| 1 (Invention) | None | | | None |
| 2 (Invention) | None | | | None |
| 3 (Comparison) | None | x | x | " |
| 4 (Comparison) | None | | Δ | Slightly None |

(*1)
no contamination of thermal head at all
slight contamination of thermal head present
Δ contamination of thermal head present
x contamination of thermal head present greatly As apparently seen from Table 1, according to this invention, no blocking occurs during storage and no contamination or abrasion of thermal heads occurs during usage, whereby generation of sticking phenomenon can be prevented.

We claim:

1. A thermal transfer recording medium comprising a support, a coloring agent layer containing a heat fusible substance formed on one surface of said support and a backing layer on the other surface of said support, wherein said backing layer contains a resin selected from the group consisting of urethane resins and vinyl chloride resins, and a higher fatty acid which is solid or meta-solid at room temperature.

2. The thermal transfer recording medium of claim 1, wherein said urethane resins and said vinyl chloride resins are soluble in a solvent.

3. The thermal transfer recording medium of claim 1, wherein said resin is a urethane resin having a softening point of from 50° C. to 200° C.

4. The thermal transfer recording medium of claim 1, wherein said resin is a vinyl chloride resin having a softening point of from 50° C. to 200° C.

5. The thermal transfer recording medium of claim 1, wherein said resin selected from the group consisting of urethane resins and vinyl chloride resins is contained in the backing layer in the range of from 50 to 98 parts by weight per 100 parts of the total amount of the backing layer.

6. The thermal transfer recording medium of claim 5, wherein said resin selected from the group consisting of urethane resins and vinyl chloride resins is contained in the backing layer in the range of from 70 to 95 parts by weight per 100 parts of the total amount of the backing layer.

7. The thermal transfer recording medium of claim 1, wherein said fatty acid is contained in the backing layer in the range of from 2 to 50 parts by weight per 100 parts of the total amount of the backing layer.

8. The thermal transfer recording medium of claim 7, wherein said fatty acid is contained in the backing layer in the range of from 5 to 30 parts by weight per 100 parts of the total amount of the backing layer.

9. The thermal transfer recording medium of claim 1, wherein said fatty acid is a fatty acid having 8 or more carbon atoms.

10. The thermal transfer recording medium of claim 9, wherein said fatty acid is a fatty acid having 12 or more carbon atoms.

11. The thermal transfer recording medium of claim 1, wherein said backing layer has a thickness of from 0.03 μm to 2.0 μm.

12. The thermal transfer recording medium of claim 11, wherein said backing layer has a thickness of from 0.1 μm to 0.5 μm.

13. The thermal transfer recording medium of claim 12, wherein said coloring agent layer has a thickness of from 2 μm to 8 μm and said support has a thickness of 2 μm to 15 μm.

14. The thermal transfer recording medium of claim 1, wherein said backing layer contains a heat fusible substance having a softening point or melting point of from 50° C. to 120° C.

15. The thermal transfer recording medium of claim 9, wherein said fatty acid is at least one selected from the group consisting of caprylic acid, capric acid, sebacic acid, lauric acid, myristic acid, palmitic acid, stearic acid, oleic acid, behenic acid, erucic acid, lignoceric acid and melissic acid.

16. The thermal transfer recording medium of claim 5, wherein said resin is soluble in a solvent and has a softening point of from 50° C. to 200° C.; said fatty acid is contained in the backing layer in the range of from 2 to 50 parts by weight per 100 parts of the total amount of the backing layer and has 8 or more carbon atoms; said backing layer has a thickness of from 0.03 μm to 2.0 μm; and said backing layer also contains a heat fusible substance having a softening point or melting point of from 50° C. to 120° C.

17. The thermal transfer recording medium of claim 16, wherein said resin selected from the group consisting of urethane resins and vinyl chloride resins is contained in the backing layer in the range of from 70 to 95 parts by weight per 100 parts of the total amount of the backing layer; said fatty acid is a fatty acid having 12 or more carbon atoms; and said backing layer has a thickness of from 0.1 μm to 0.5 μm.

18. The thermal transfer recording medium of claim 17, wherein said fatty acid is contained in the backing layer in the range of from 5 to 30 parts by weight per 100 parts of the total amount of the backing layer; said coloring agent layer has a thickness of from 2 μm to 8 μm and said support has a thickness of 2 μm to 15 μm; and said fatty acid is at least one selected from the group consisting of caprylic acid, capric acid, sebacic acid, lauric acid, myristic acid, palmitic acid, stearic acid, oleic acid, behenic acid, erucic acid, lignoceric acid and melissic acid.

19. The thermal transfer recording medium of claim 18, wherein said resin is a urethane resin.

20. The thermal transfer recording medium of claim 18, wherein said resin is a vinyl chloride resin.

* * * * *